US011717933B2

(12) United States Patent
Ro

(10) Patent No.: US 11,717,933 B2
(45) Date of Patent: Aug. 8, 2023

(54) RETAINING RING FOR USE IN CHEMICAL MECHANICAL POLISHING AND CMP APPARATUS HAVING THE SAME

(71) Applicant: XIA TAI XIN SEMICONDUCTOR (QING DAO) LTD., Qingdao (CN)

(72) Inventor: Yong-Seok Ro, Singapore (SG)

(73) Assignee: XIA TAI XIN SEMICONDUCTOR (QING DAO) LTD., Qingdao (CN)

( * ) Notice: Subject to any disclaimer, the term of this patent is extended or adjusted under 35 U.S.C. 154(b) by 782 days.

(21) Appl. No.: 16/737,782

(22) Filed: Jan. 8, 2020

(65) Prior Publication Data

US 2021/0086324 A1 Mar. 25, 2021

(30) Foreign Application Priority Data

Sep. 25, 2019 (CN) ..... 201910913131.1

(51) Int. Cl.
*B24B 37/32* (2012.01)
*B24B 37/26* (2012.01)
*B24B 37/10* (2012.01)

(52) U.S. Cl.
CPC ..... *B24B 37/32* (2013.01); *B24B 37/105* (2013.01); *B24B 37/26* (2013.01)

(58) Field of Classification Search
CPC ..... B24B 37/32; B24B 37/27; B24B 37/30; B24B 37/04; B24B 37/042; B24B 37/07; B24B 37/10; B24B 37/105; B24B 7/228
USPC ..... 451/285
See application file for complete search history.

(56) References Cited

U.S. PATENT DOCUMENTS

2006/0148385 A1* 7/2006 Phang ..... B24B 37/32 451/41
2008/0090497 A1* 4/2008 Wang ..... B24B 37/32 451/286
2016/0271750 A1* 9/2016 Hu ..... B24B 37/32

FOREIGN PATENT DOCUMENTS

CN 109475997 A 3/2019

* cited by examiner

*Primary Examiner* — Brian D Keller
*Assistant Examiner* — Robert C Moore
(74) *Attorney, Agent, or Firm* — ScienBiziP, P.C.

(57) ABSTRACT

The present disclosure provides a retaining ring for polishing a wafer by a slurry. The retaining ring includes a ring-shaped main body and a plurality of guiding elements. The main body has an outer surface, an inner surface, and an inner space for accommodating the wafer. The main body includes a plurality of channels configured to allow the slurry to flow into the inner space from the outer surface. The plurality of guiding elements is disposed at the outer surface of the main body with respect to the plurality of channels. Each of the guiding elements forms a slurry capture area with the main body to guide the slurry towards each of the respective channels.

19 Claims, 7 Drawing Sheets

RETAINING RING FOR USE IN CHEMICAL MECHANICAL POLISHING AND CMP APPARATUS HAVING THE SAME

CROSS-REFERENCE TO RELATED APPLICATION

This application claims the benefit of and priority to a Chinese Patent Application No. 201910913131.1 filed on Sep. 25, 2019, the entire content of which is incorporated by reference herein.

FIELD

The present disclosure generally relates to a retaining ring for use in chemical mechanical polishing (CMP) and a CMP apparatus having the same. More specifically, the present disclosure relates to a retaining ring for use in CMP that has guiding elements around its outer surface to capture slurry.

BACKGROUND

Chemical mechanical polishing or chemical mechanical planarization (CMP) is a process whereby a semiconductor wafer is held in retaining ring against a rotating polishing surface, or moved relative to the polishing surface, under controlled conditions of temperature, pressure, and chemical composition. The polished surface, which may be a planar pad formed of a relatively soft and porous material such as a blown polyurethane, wetted with a chemically reactive and abrasive aqueous slurry. The aqueous slurry, which may be either acidic or basic, typically includes abrasive particles, reactive chemical agent such as a transition metal chelated salt or an oxidizer, and adjuvants such as solvents, buffers, and passivating agents. Within the slurry, salts or other agents may facilitate chemical etching actions, while the abrasive particles and the polishing pad together may facilitate the mechanical polishing actions.

During the polishing process, the slurry is continuously supplied to the polishing pad by nozzles or through the retaining ring. A large amount of the slurry is wasted as the wafer rotates or moves. Usually, only 25% of the slurry is contributing to the polishing process, and 75% of the slurry is wasted.

Accordingly, there is a need to provide a CMP apparatus to overcome the aforementioned problems.

SUMMARY

The present disclosure is directed to a retaining ring for use in chemical mechanical polishing (CMP) to improve the usage efficiency of slurry.

An implementation of the present disclosure provides a retaining ring for polishing a wafer by a slurry. The retaining ring includes a ring-shaped main body and a plurality of guiding elements. The main body has an outer surface, an inner surface, and an inner space for accommodating the wafer. The main body includes a plurality of channels configured to allow the slurry to flow into the inner space from the outer surface. The guiding elements are disposed at the outer surface of the main body with respect to the plurality of channels. Each of the guiding elements forms a slurry capture area with the main body to guide the slurry towards each of the respective channels.

Another implementation of the present disclosure provides a chemical mechanical polishing (CMP) apparatus for chemical mechanical polishing a wafer. The CMP apparatus includes a platen, a retaining ring, and a carrier head. The platen has a polishing pad for polishing the wafer by a slurry. The carrier head is connected to the retaining ring and configured to rotate the retaining ring. The retaining ring includes a ring-shaped main body and a plurality of guiding elements. The main body has an outer surface, an inner surface, and an inner space for accommodating the wafer. The main body includes a plurality of channels configured to allow the slurry to flow into the inner space from the outer surface. The guiding elements are disposed at the outer surface of the main body with respect to the plurality of channels. Each of the guiding elements forms a slurry capture area with the main body to guide the slurry towards each of the respective channels.

As described above, the retaining ring of the present disclosure has a plurality of guiding elements around its outer surface. Each of the guiding elements forms a slurry capture area with the outer surface of the retaining ring and guides the slurry towards the wafer disposed in the retaining ring through a plurality of channels. Therefore, the use efficiency of the slurry can be improved.

BRIEF DESCRIPTION OF THE DRAWINGS

Implementations of the present technology will now be described, by way of example only, with reference to the attached figures.

DETAILED DESCRIPTION

Figure 1:
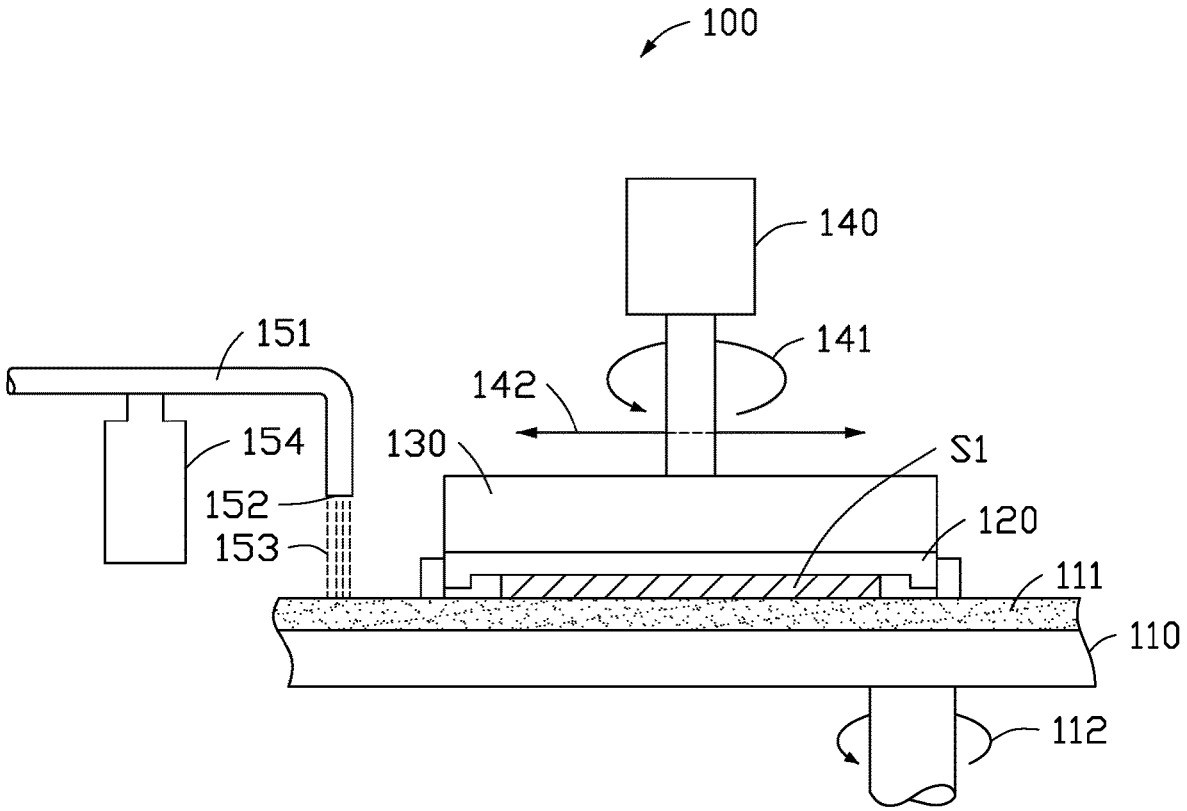
FIG. 1 is a schematic diagram of a CMP apparatus.

The present disclosure will now be described more fully hereinafter with reference to the accompanying drawings, in which example implementations of the disclosure are shown. This disclosure may, however, be embodied in many different forms and should not be construed as limited to the example implementations set forth herein. Rather, these example implementations are provided so that this disclosure will be thorough and complete, and will fully convey the scope of the disclosure to those skilled in the art. Like reference numerals refer to like elements throughout.

The terminology used herein is for the purpose of describing particular example implementations only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, actions, operations, elements, and/or components, but do not preclude the presence or addition of one or more other features, regions, integers, actions, operations, elements, components, and/or groups thereof.

It will be understood that the term "and/or" includes any and all combinations of one or more of the associated listed items. It will also be understood that, although the terms first, second, third etc. may be used herein to describe various elements, components, regions, parts and/or sections, these elements, components, regions, parts and/or sections should not be limited by these terms. These terms are only used to distinguish one element, component, region, part or section from another element, component, region, layer or section. Thus, a first element, component, region, part or section discussed below could be termed a second element, component, region, layer or section without departing from the teachings of the present disclosure.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the example implementations of the present disclosure in conjunction with the accompanying drawings in FIGS. 1 through 3B. Reference will be made to the drawing figures to describe the present disclosure in detail, wherein depicted elements are not necessarily shown to scale and wherein like or similar elements are designated by same or similar reference numeral through the several views and same or similar terminology.

The present disclosure will be further described hereafter in combination with the accompanying figures.

Referring to FIG. 1, a schematic diagram of a chemical mechanical polishing (CMP) apparatus is illustrated. A CMP apparatus 100 includes a carrier head 130 and a retaining ring 120 for polishing a semiconductor wafer S1 by a slurry 153. The wafer S1 is held in the retaining ring 120. A soft pad (not shown in FIG. 1) is positioned between the retaining ring 120 and the wafer S1, with the wafer S1 being held against the soft pad by a partial vacuum or with an adhesive. The carrier head 130 is provided to be continuously rotated by a drive motor 140, in direction 141, and optionally reciprocated transversely in directions 142. Accordingly, the combined rotational and transverse movements of the wafer S1 are intended to reduce the variability in the material removal rate across the surface of the wafer S1. The CMP apparatus 100 further includes a platen 110, which is rotated in direction 112. A polishing pad 111 is mounted on the platen 110. As compared to the wafer S1, the platen 110 is provided with a relatively large surface area to accommodate the translational movement of the wafer S1 on the retaining ring 120 across the surface of the polishing pad 111. A supply tube 151 is mounted above the platen 110 to deliver a stream of the polishing slurry 153, which is dripped onto the surface of the polishing pad 111 from a nozzle 152 of the supply tube 151. The slurry 153 may be gravity fed from a tank or reservoir (not shown), or pumped through the supply tube 151. Alternatively, the slurry 153 may be supplied from below the platen 110 such that it flows upwardly through the underside of the polishing pad 111. In another implementation, the slurry may be supplied in the retaining ring 120 by nozzles disposed in the retaining ring 120. If the particles in the slurry 153 form agglomeration of undesirable large particles, the wafer surface would be scratched when the wafer S1 is being polished. Therefore, the slurry 153 need to be filtered to remove the undesirable large particles. Usually, a filter assembly 154 is coupled to the supply tube 151 to separate agglomerated or oversized particles.

Figure 2A:
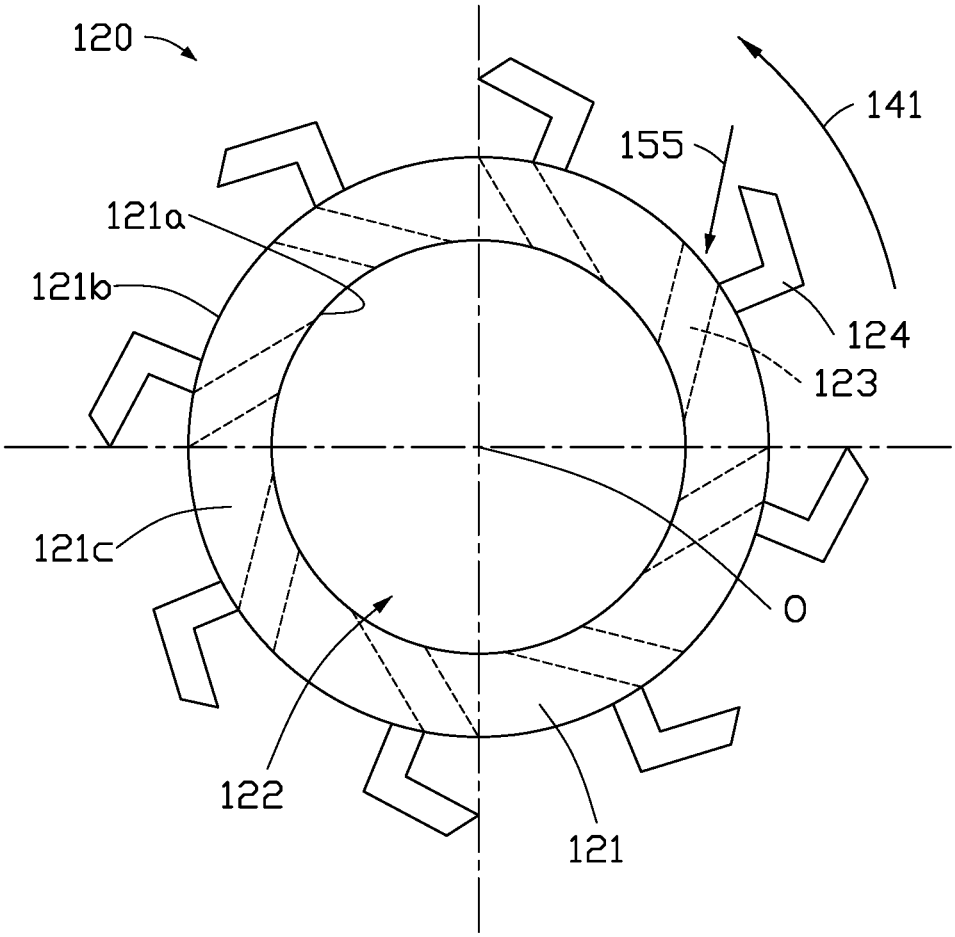
FIG. 2A is a top view of a retaining ring of the CMP apparatus of FIG. 1 according to an implementation of the present disclosure.
Figure 2B:
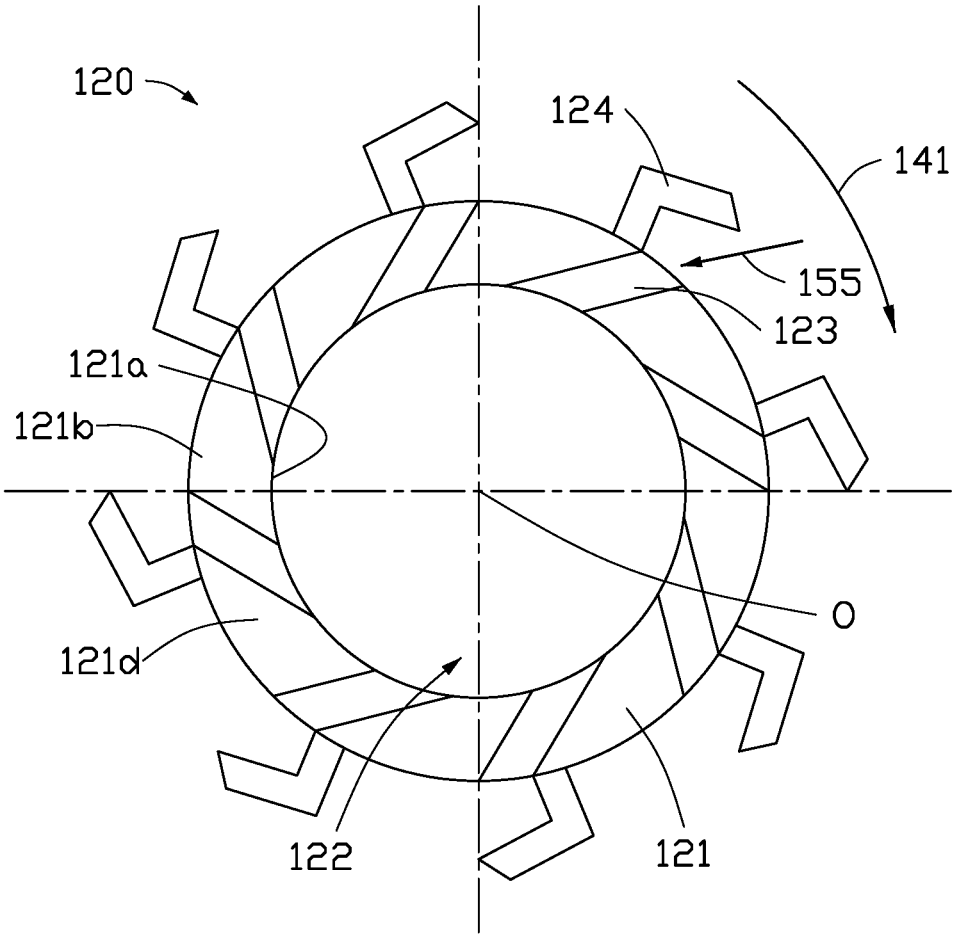
FIG. 2B is a bottom view of the retaining ring in FIG. 2A.
Figure 2C:
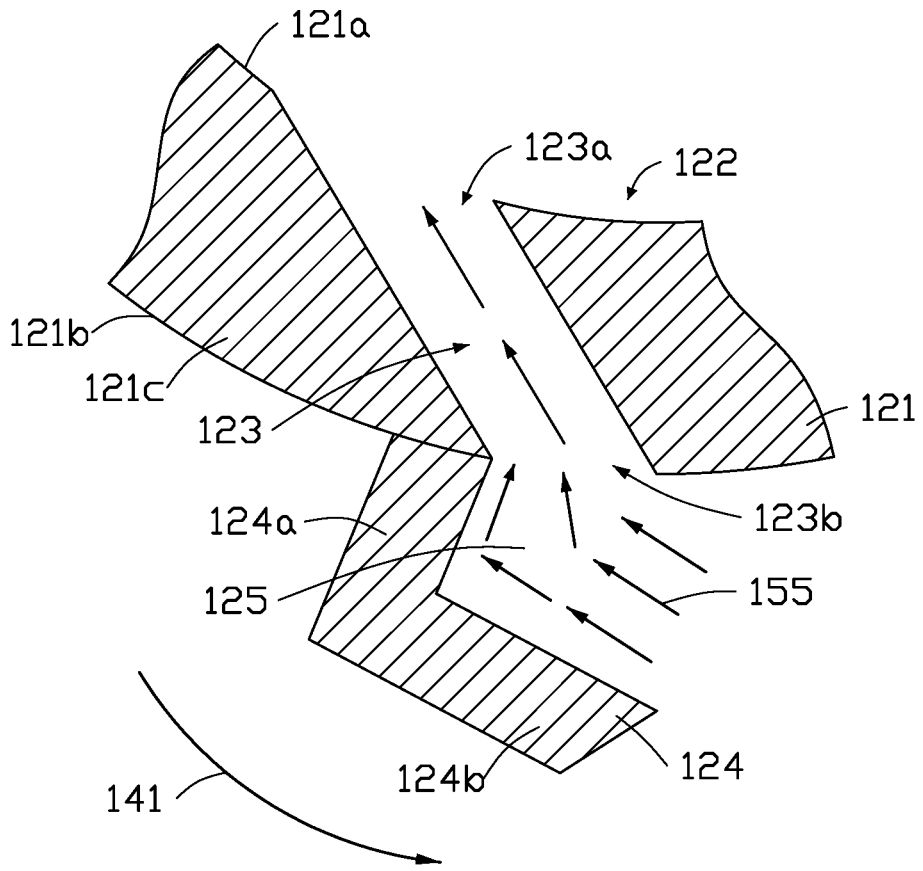
FIG. 2C is a partially enlarged view of the retaining ring in FIG. 2A.
Figure 2D:
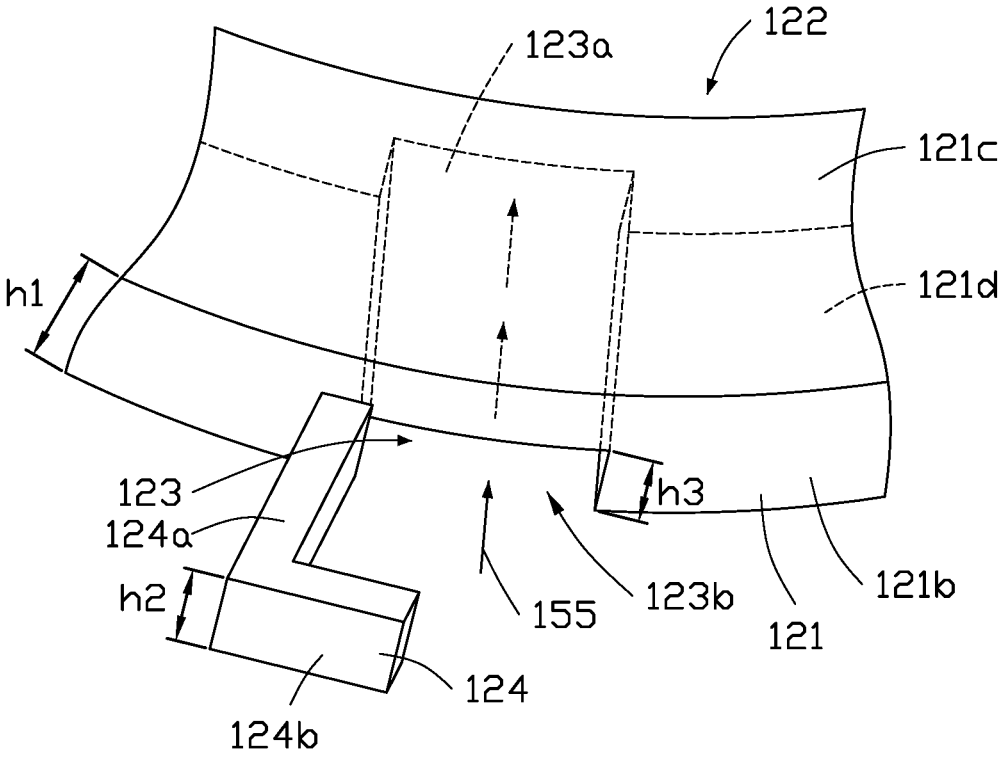
FIG. 2D is a partially enlarged perspective view of the retaining ring in FIG. 2A.

Referring to FIGS. 2A to 2D, schematic views of a retaining ring of a CMP apparatus are illustrated. In one implementation, the retaining rings as illustrated in FIGS. 2A through 2D, may each correspond to the retaining ring 120 of the CMP apparatus 100 in FIG. 1. FIGS. 2A and 2B are respectively a top view and a bottom view of the retaining ring 120 according to an implementation of the present disclosure. FIG. 2C is a partially enlarged view of the retaining ring 120. FIG. 2D is a partially enlarged perspective view of the retaining ring 120. The retaining ring 120 includes a ring-shaped main body 121 and a plurality of guiding elements 124. The main body 121 has an outer surface 121*b*, an inner surface 121*a*, and an inner space 122 for accommodating the wafer S1. The main body 121 includes a plurality of channels 123 configured to allow the slurry to flow into the inner space 122 from the outer surface 121*b*. The flow of slurry is depicted by direction 155. The main body 121 may be made from polyphenyl sulfide (PPS), polyimide, polybenzimidazole (PBI), polytetrafluoroethylene (PTFE), polyetheretherketone (PEEK), polycarbonate, acetal, polyetherimide (PEI), or any combination thereof.

The plurality of guiding elements 124 is disposed at the outer surface 121*b* of the main body 121 with respect to the plurality of channels 123. As shown in FIG. 2A, in the present implementation, the retaining ring 120 includes eight channels 123 and eight guiding elements 124 with respect to the eight channels 123. Each of the guiding elements 124 may be made from polyphenyl sulfide (PPS), polyimide, polybenzimidazole (PBI), polytetrafluoroethylene (PTFE), polyetheretherketone (PEEK), polycarbonate, acetal, polyetherimide (PEI), or any combination thereof. The guiding elements 124 may be made from the same material as the main body 121. The guiding elements 124 may be constructed integrally with the main body 121 or as separate components from the main body 121. Each of the guiding elements 124 forms a slurry capture area 125 with the main body 121 to guide the slurry towards each of the respective channels 123, as shown in FIG. 2C. Each of the channels 123 connects between the slurry capture area 125 and the inner space 122 to allow the slurry flow into the inner space 122 from the slurry capture area 125, as shown by the direction 155 in FIG. 2C.

The main body further includes a top surface 121*c* and a bottom surface 121*d* parallel to the top surface 121*c*. Each of the channels 123 is a groove having a rectangular cross-section disposed on the bottom surface 121*d* of the main body 121. Each of the channels 123 has an outer opening 123*b* disposed at the outer surface 121*b* of the main body 121, and an inner opening 123*a* disposed at the inner surface 121*a* of the main body 121.

The main body 121 has a rotation axis O. The channels 123 are spaced at substantially equal angular intervals around the rotation axis O of the main body 121. The retaining ring 120 is configured to rotate in polishing direction 141 around the rotation axis O to polish the wafer S1. Each of the guiding elements 124 is extended from the outer surface 121*b* of the main body 121 towards the polishing direction 141. In this implementation, each of the guiding elements 124 has a V-shaped structure. More specifically, each of the guiding elements 124 includes a first portion 124*a* and a second portion 124*b* connected to the first portion 124*a*. One end of the first portion is connected to the outer surface 121*b* of the main body 121. The second portion

124*b* is extended from another end of the first portion 124*a* towards the polishing direction 141.

As shown in FIG. 2D, the main body 121 has a first height h1; each of the guiding elements 124 has a second height h2; and each of the channels 123 has a third height h3. The first height h1 of the main body 121 is greater than the second height h2 of the guiding element 124. The second height h2 of the guiding element 124 is greater than the third height h3 of the channel 123.

Figure 3A:
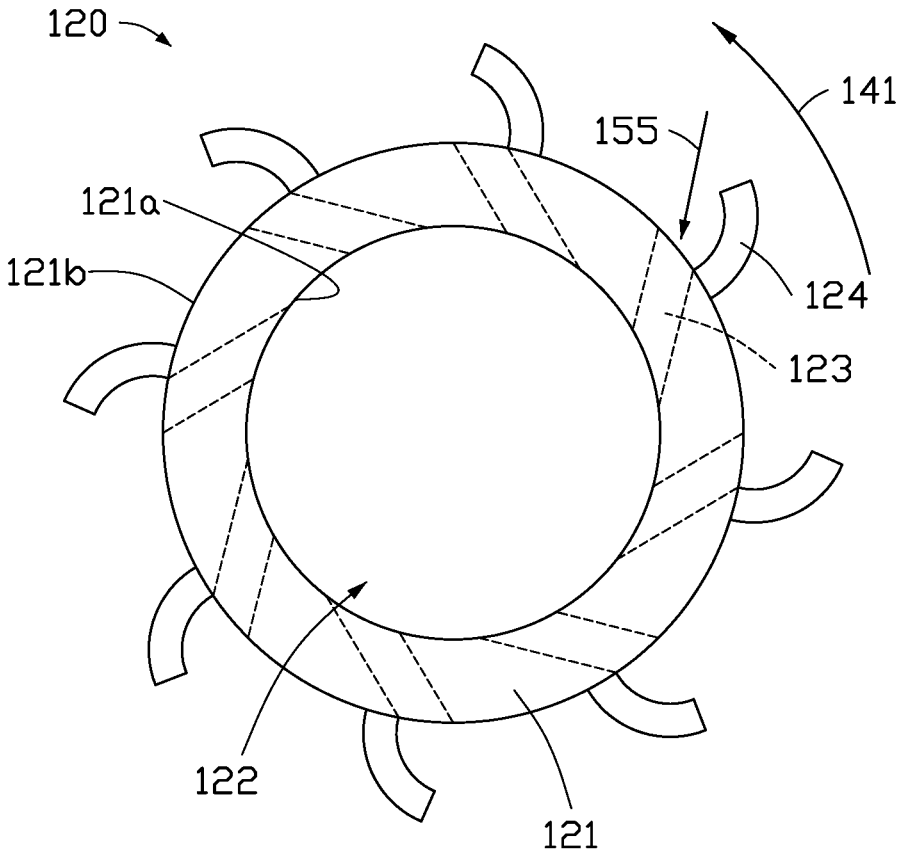
FIG. 3A is a top view of a retaining ring according to another implementation of the present disclosure.
Figure 3B:
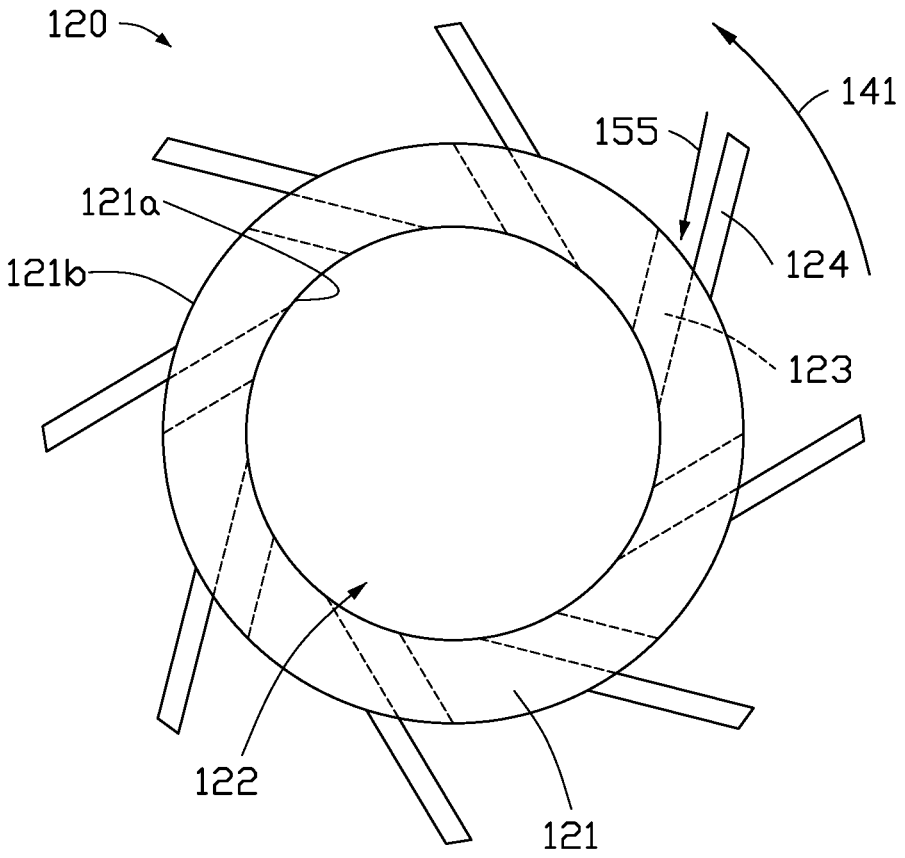
FIG. 3B is a top view of a retaining ring according to another implementation of the present disclosure.

Referring to FIGS. 3A and 3B, top views of the retaining ring 120 having the guiding elements 124 according to various implementations are illustrated. As shown in FIG. 3A, in one implementation, each of the guiding elements 124 has an arc-shaped structure. As shown in FIG. 3B, in one implementation, each of the guiding elements 124 is a blade extended from the outer surface 121*b* of the main body 121. The other remaining portions/elements of the retaining ring 120 in FIGS. 3A and 3B may be substantially similar to those described with reference to the retaining ring 120 in FIGS. 2A through 2D, the details of which are omitted for brevity. Various implementations of the present disclosure provides a chemical mechanical (CMP) apparatus for polishing a wafer. The CMP apparatus of the present disclosure can be referred to the CMP apparatus 100 as shown in FIG. 1. The CMP apparatus 100 includes the platen 110, the retaining ring 120 and the carrier head 130. The platen 110 has the polishing pad 111 for polishing the wafer S1 by the slurry 153. The retaining ring 120 is configured to hold the wafer S1. The carrier head 130 is connected to the retaining ring 120 and configured to rotate the retaining ring 120. The CMP apparatus 100 further includes the drive motor 140 connected to the carrier head 130 to rotate the carrier head 130 in the direction 141, and optionally reciprocated transversely in the directions 142. The CMP apparatus 100 may further includes the supply tube 151 configured to supply the slurry 153 from the nozzle 152. The retaining ring 120 of the CMP apparatus 100 includes a plurality of guiding elements around its outer surface to capture the slurry 153 to improve the use efficiency of the slurry 153. The details of the retaining ring 120 can be referred to FIGS. 2A through 3B and descriptions of the previous implementations.

As described above, the retaining ring of the implementations of the present disclosure has a plurality of guiding elements around its outer surface. Each of the guiding element forms a slurry capture area with the outer surface of the retaining ring and guides the slurry towards the wafer disposed in the retaining ring through a plurality of channels. Therefore, the usage efficiency of the slurry can be improved.

The implementations shown and described above are only examples. Many details are often found in the art such as the other features of a retaining ring for use in chemical mechanical polishing and a CMP apparatus having the same. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the implementations described above may be modified within the scope of the claims.

What is claimed is:

1. A retaining ring for polishing a wafer by a slurry, comprising:

a ring-shaped main body having an outer surface, an inner surface, and an inner space for accommodating the wafer, the main body comprising a plurality of channels configured to allow the slurry to flow into the inner space from the outer surface; and a plurality of guiding elements disposed at the outer surface of the main body with respect to the plurality of channels, each of the guiding elements forming a slurry capture area with the main body to guide the slurry towards each of the respective channels;

wherein the main body has a first height, each of the guiding elements has a second height, each of the channels has a third height, the first height is greater than the second height, and the second height is greater than the third height.

2. The retaining ring of claim 1, wherein the main body further comprises a top surface and a bottom surface parallel to the top surface.

3. The retaining ring of claim 2, wherein each of the channels is a groove disposed at the bottom surface of the main body.

4. The retaining ring of claim 1, wherein the main body has a rotation axis, and the channels are spaced at substantially equal angular intervals around the rotation axis of the main body.

5. The retaining ring of claim 1, wherein each of the channels has an outer opening disposed at the outer surface of the main body, and an inner opening disposed at the inner surface of the main body.

6. The retaining ring of claim 1, wherein the retaining ring is configured to rotate in a polishing direction around a rotation axis to polish the wafer, and each of the guiding elements is extended from the outer surface of the main body towards the polishing direction.

7. The retaining ring of claim 6, wherein each of the guiding elements comprise a first portion and a second portion connected to the first portion, one end of the first portion is connected to the outer surface of the main body, and the second portion is extended from another end of the first portion towards the polishing direction.

8. The retaining ring of claim 1, wherein each of the guiding elements has a V-shaped structure.

9. The retaining ring of claim 1, wherein each of the guiding elements has an arc-shaped structure.

10. The retaining ring of claim 1, wherein each of the guiding elements is a blade extended from the outer surface of the main body.

11. A chemical mechanical polishing (CMP) apparatus for polishing a wafer, comprising:

a platen having a polishing pad for polishing the wafer by a slurry;

a retaining ring configured to hold the wafer, comprising:

a ring-shaped main body having an outer surface, an inner surface, and an inner space for accommodating the wafer, the main body comprising a plurality of channels configured to allow the slurry to flow into the inner space from the outer surface; and a plurality of guiding elements disposed at the outer surface of the main body with respect to the plurality of channels, each of the guiding elements forming a slurry capture area with the main body to guide the slurry towards each of the respective channels; and a carrier head connected to the retaining ring and configured to rotate the retaining ring;

wherein the main body has a first height, each of the guiding elements has a second height, each of the channels has a third height, the first height is greater than the second height, and the second height is greater than the third height.

12. The CMP apparatus of claim 11, further comprising a drive motor connected to the carrier head.

13. The CMP apparatus of claim 11, further comprising a supply tube configured to supply the slurry from a nozzle.

14. The CMP apparatus of claim 11, wherein the main body of the retaining ring has a rotation axis, and the channels of the retaining ring are spaced at substantially equal angular intervals around the rotation axis of the main body.

15. The CMP apparatus of claim 11, wherein the retaining ring is configured to rotate in a polishing direction around a rotation axis to polish the wafer, and each of the guiding elements is extended from the outer surface of the main body towards the polishing direction.

16. The CMP apparatus of claim 12, wherein each of the guiding elements comprise a first portion and a second portion connected to the first portion, one end of the first portion is connected to the outer surface of the main body, and the second portion is extended from another end of the first portion towards the polishing direction.

17. The CMP apparatus of claim 11, wherein each of the guiding elements of the retaining ring has a V-shaped structure.

18. The CMP apparatus of claim 11, wherein each of the guiding elements of the retaining ring has an arc-shaped structure.

19. The CMP apparatus of claim 11, wherein each of the guiding elements of the retaining ring is a blade extended from the outer surface of the main body.

* * * * *